United States Patent [19]

Kadar et al.

[11] 4,077,115

[45] Mar. 7, 1978

[54] METHOD OF MAKING THE SAME ELECTRIC SLIDER

[75] Inventors: Ferenc Kádár; Gyula Galambos, both of Budapest, Hungary

[73] Assignee: REMIX Rádiótechnikai Vállalat, Budapest, Hungary

[21] Appl. No.: 769,926

[22] Filed: Feb. 18, 1977

Related U.S. Application Data

[62] Division of Ser. No. 622,435, Oct. 14, 1975, Pat. No. 4,050,051.

[51] Int. Cl.[2] ..... H01R 9/16; H01R 43/02

[52] U.S. Cl. ..... 29/630 B; 29/423; 228/160; 228/173 E

[58] Field of Search ..... 29/630 B, 630 R, 423, 29/412, 416; 338/183, 202; 228/160, 161, 159, 173; 140/88

[56] References Cited

U.S. PATENT DOCUMENTS

| | | | |
|---|---|---|---|
| 2,798,137 | 7/1957 | Rasmussen | 338/202 X |
| 2,966,726 | 1/1961 | Gallentine et al. | 140/88 X |
| 3,569,897 | 3/1971 | Laube | 29/630 B X |
| 3,580,030 | 5/1971 | Bean | 140/88 X |
| 3,930,308 | 1/1976 | Munro | 29/630 R |

FOREIGN PATENT DOCUMENTS

| | | | |
|---|---|---|---|
| 155,036 | 10/1969 | Hungary | 29/630 B |

*Primary Examiner*—Victor A. DiPalma
*Attorney, Agent, or Firm*—Spencer & Kaye

[57] ABSTRACT

An electric slider comprises a plurality of independently springing, aligned, uniformly spaced contact elements mechanically and electrically connected to one another. Each contact element is of elongated C shape having a discontinuity at one of its short sides. Each contact element comprises a base portion at which the contact element is connected to an adjoining contact element, a contact portion and a springing portion connecting the contact portion with the base portion. The contact portion is of circular cross section and at least part of the springing portion along a long side of the contact element is of flattened cross section. The plane of the flattened cross section is so oriented that the springing portion has, in the direction perpendicular to the slider motion, a moment of inertia that is larger than that of a circular cross section and, in the direction determining the resilient pressure, has a moment of inertia that is smaller than that of a circular cross section.

3 Claims, 8 Drawing Figures

FIG. 1
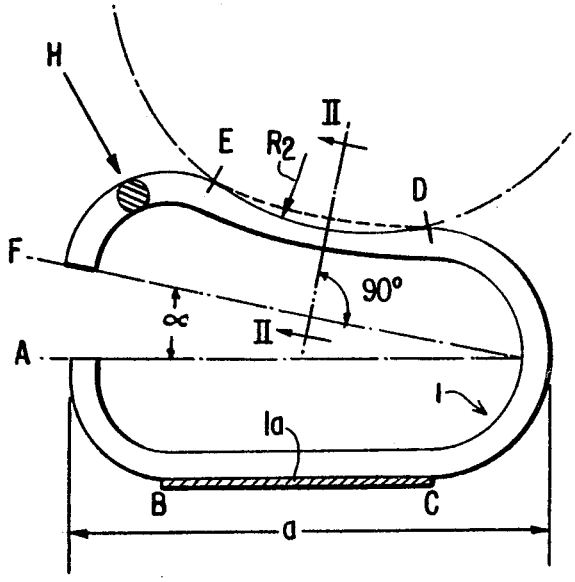
FIG. 2
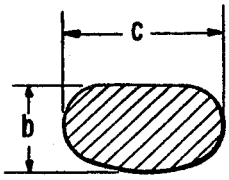
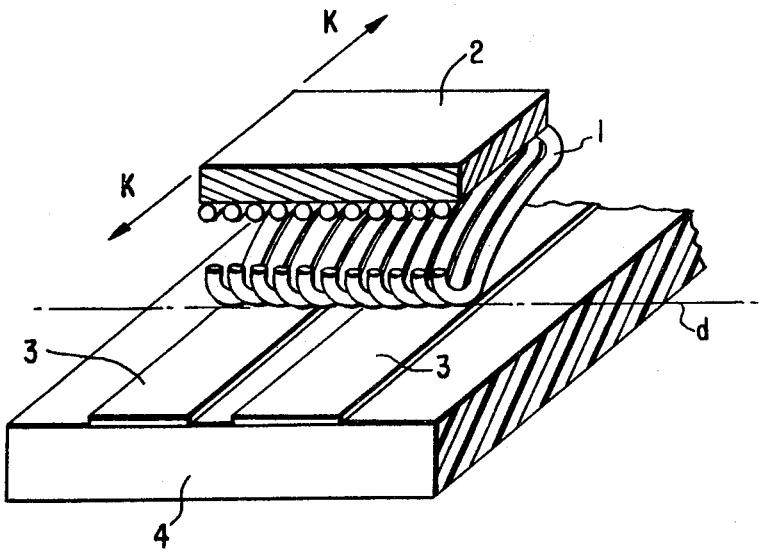
FIG. 3

METHOD OF MAKING THE SAME ELECTRIC SLIDER

CROSS-REFERENCE TO RELATED APPLICATION

This application is a division of copending Application Ser. No. 622,435, filed Oct. 14th, 1975 now U.S. Pat. No. 4,050,051.

BACKGROUND OF THE INVENTION

This invention relates to a slider having a plurality of resilient contact fingers slidably engaging an electric conductor. The slider is used in particular for variable electric resistors which find application, for example, in measuring or regulating instruments. The invention also relates to a method of manufacturing such a slider and further, to a resistor incorporating the slider.

It is known that in variable resistors, particularly of the relatively high-ohmic type, the contact resistance between the slider and the conductor (resistor track) varies along the path of regulation. This phenomenon adversely affects the accuracy of setting as well as the fidelity of current transfer and further causes operational noises.

Assuming that a carbon or cermet resistor track consists of infinitely small particles in perfectly homogeneous distribution and further assuming that the slider has a perfectly spherical surface, in first approximation a noise-free operation and a constant contact resistance would be achieved along the path of regulation. In practice, however, these requirements cannot be accomplished with resistor tracks formed either of wire coil resistors or granules distributed in a carrier substrate. For this reason, in most known structures, linearly or quasi-spherically shaped contact elements of increased contact surface are used with the application of correspondingly high contact pressures.

For maintaining the contact resistance at an as low and as constant a value as possible, the contact pressure has to be maintained constant at an accurate predetermined value. This contact pressure — which is necessarily high — causes an undesired and often premature wear of the path of contact of the resistor track.

It is known to use in sliders of the above type a plurality of resilient leaf spring fingers arranged in a fan-like manner. Sliders are further known which comprise a wire helix contacting the conductor track at several points to obtain a plural, although linear, contact arrangement.

The plate cross section oriented perpendicularly to the direction of slider motion ensures a favorable moment of inertia of the contact fingers. The linear contact — which is more likely a surface contact — conventionally resulting from such an arrangement is, however, disadvantageous. According to another known solution, a resiliently arranged helix of curved axis is used as a multiple contact. This arrangement is advantageous in that the individual contacts (elemental contacts) are in engagement with the resistor track along a cylindrical surface. Thus, in principle, a linear contacting is ensured. On the other hand, however, this arrangement has the disadvantage that the moment of inertia perpendicularly to the direction of slider motion is small. This is so because the moment of inertia is determined by the cross section of the helix wire and the exact reproduction of the once set angle value is affected precisely by the elasticity of the helix. Thus, in this case no stringent requirements can be established regarding reproducibility.

SUMMARY OF THE INVENTION

It is an object of the invention to provide an improved slider of the above-outlined type which possesses the described advantages, but is free from the described disadvantages.

It is a further object of the invention to provide a method for the continuous manufacture of such slider.

It is still another object of the invention to provide a variable resistor incorporating such slider.

These objects and others to become apparent as the specification progresses, are accomplished by the invention according to which, briefly stated, the slider comprises a plurality of independently springing, aligned, uniformly spaced contact elements mechanically and electrically connected to one another. Each contact element is of elongated C shape having a discontinuity at one of its short sides. Each contact element comprises a base portion at which the contact element is connected to an adjoining contact element, a contact portion and a springing portion connecting the contact portion with the base portion. The contact portion is of circular cross section to ensure an approximately circular, point-like contact with a conductor track. At least part of the springing portion along a long side of the contact element is of flattened cross section. The plane of the flattened cross section is so oriented that the springing portion has, in the direction perpendicular to the slider motion, a moment of inertia that is larger than that of a circular cross section and, in the direction determining the resilient pressure has a moment of inertia that is smaller than that of a circular cross section.

The method of manufacturing the slider according to the invention comprises a further development and modification of the known process disclosed in Hungarian Pat. No. 155.036. According to the known process disclosed in this patent, a continuous wire helix is provided on a ductile core wire which is preferably insulated. By means of a rolling operation the helix is partially pressed into the core wire, whereby the helix is fixedly supported. According to the invention, the wire system comprising a core wire (mandrel) and a wire helix flattened at opposite sides is, as an extension of the known method, further unilaterally deformed by means of a roll having a convex rolling face, the radius of curvature of which is smaller than the radius of a circle circumscribable about the circumferential outline of the flattened helix. This deformation is effected in such a manner that the ratio of the small side to the large side of the cross section of the deformed helix wire is preferably between 1:1.5 and 1:3. Subsequently, the turns of the helix are, at those sides which are opposite the cross-sectionally deformed locations, mechanically and electrically connected to one another by soldering or any other known method. This is expediently effected with the aid of a metallic band positioned on the helix. Subsequently, the turns of the helix are slit open in a plane which is oriented substantially perpendicular to the minor diameter of the flattened cross section of the helix wire. Then the mandrel can be removed with ease since each turn of the helix has now sprung open. Thereafter, the article is severed into the required lengths.

In a variable resistor incorporating the slider according to the invention, the imaginary line connecting the locations of contact between the individual contact elements and the resistor track forms an angle of 90° ± 15° with the direction of slider motion.

BRIEF DESCRIPTION OF THE DRAWINGS

FIG. 1 is a side elevational view of a preferred embodiment of one contact element.

FIG. 2 is a sectional view taken along line II—II of FIG. 1.

FIG. 3 is a fragmentary perspective view of a first type of potentiometer incorporating the slider designed according to the invention.

DESCRIPTION OF THE PREFERRED EMBODIMENTS

Figure 6:
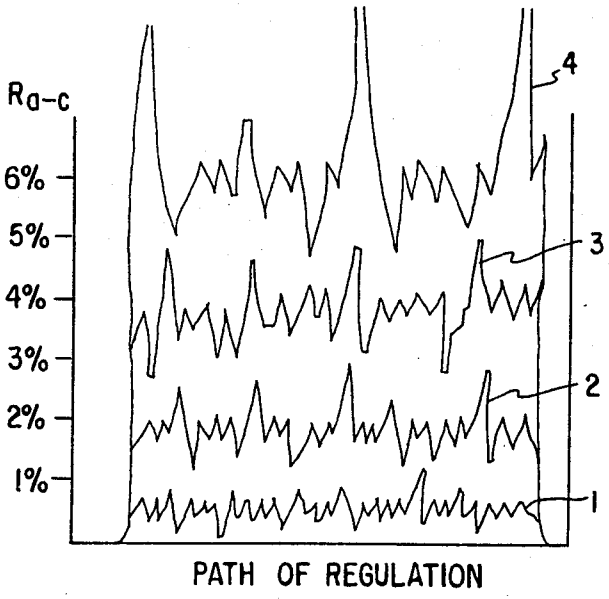
FIG. 6 is a diagram illustrating the percentage change of contact resistance in a variable resistor as a function of the position of the slider along the path of regulation.

Turning now to FIG. 1, there is shown, in side elevational view, one contact element 1 of a slider which, as it was indicated above, has at least two such contact elements. Each contact element 1 is made of a spring wire and has the shape of an elongated "C" having a discontinuity of an opening angle $\alpha$.

The contact element 1 has, in essence, three portions: a base portion $\overline{AC}$, a springing portion $\overline{CE}$ and a contact portion $\overline{EF}$.

The base portion $\overline{AC}$ is formed of an arcuate part $\overline{AB}$ and a substantially linearly extending portion $\overline{BC}$. As it will be described in more detail as the specification progresses, a plurality of contact elements 1 are electrically and mechanically connected to one another in a uniformly spaced manner at the outer face of the length portion $\overline{BC}$, for example, by a solder 1*a*.

The springing portion $\overline{CE}$ is also formed of two parts: a circularly arcuate part $\overline{CD}$ which adjoins the base portion $\overline{AC}$ and a length portion $\overline{DE}$ which has a substantially linear course. The cross section of the wire of the length portion $\overline{DE}$ is flattened by virtue of an arcuate depression which extends from D to E with a radius of curvature R. Advantageously, R is smaller than one half of the greatest diameter *a* of the contact element 1. Since the opposite side of the wire length portion $\overline{DE}$ remains generally linear, the cross section of the wire along length portion $\overline{DE}$ is flattened as shown in FIG. 2 which illustrates a cross section of the wire portion $\overline{DE}$ taken at line II—II (which is normal to the upper leg of the opening angle $\alpha$). The flatness of this wire length portion is preferably such that the ratio of the minor diameter *b* to the major diameter *c l is* 1:1.5 to 1:3. The major diameter *c* of the wire cross section is so oriented that it is substantially perpendicular to the direction of a springing motion of the contact element portion $\overline{DF}$ to the contact element portion $\overline{AC}$.

The contact portion $\overline{EF}$ of the contact element 1 adjoins the springing portion $\overline{CE}$ and has a circularly arcuate course. The location of contact between the conductor (not shown in FIG. 1) and the contact portion $\overline{EF}$ of the contact element 1 is indicated by the arrow H. As further shown in FIG. 1, the contact portion $\overline{EF}$ — at least at the location of contact illustrated by the arrow H — is of circular cross section.

It is thus seen that the contact element 1 has a first long side substantially constituted by the base part $\overline{BC}$, a second long side substantially formed by the springing part $\overline{DE}$, a first short side substantially formed by the contact portion $\overline{EF}$ and the base part $\overline{AB}$ as well as a second short side substantially constituted by the springing part $\overline{CD}$.

Turning now to FIG. 3, there is shown a first example of a potentiometer incorporating the slider designed according to the invention. The slider in essence comprises a plurality of contact elements 1 which are affixed at their base portion to a carrier 2 and are, either through the carrier 2 or by means of soldering, electrically and mechanically connected to one another. The contact elements 1 are slightly spaced from one another and are urged by their own resiliency against two parallel-extending, spaced resistor tracks 3. The resistor tracks 3 are attached to an insulator substrate 4 of the potentiometer. The slider 1, 2 is movable in the direction indicated by the arrows K. Further, the imaginary line *d* which interconnects the series of point-like contacts between each contact element 1 and the resistor track 3 forms an angle of 90° ± 15° with the direction of motion K of the slider.

Figure 5:
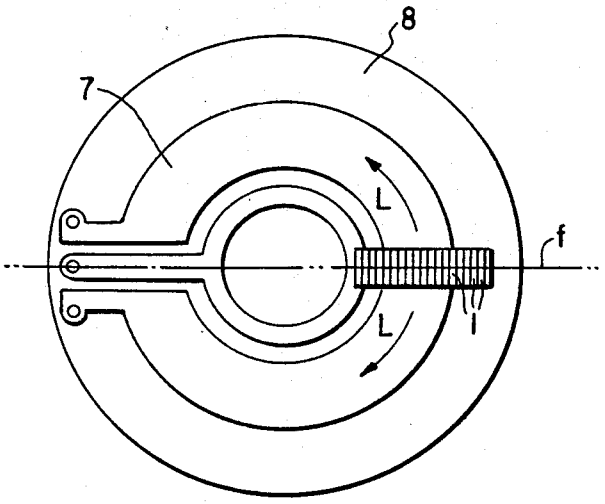
FIG. 5 is a plan view, partially in section, taken along line V—V of FIG. 4.
Figure 4:
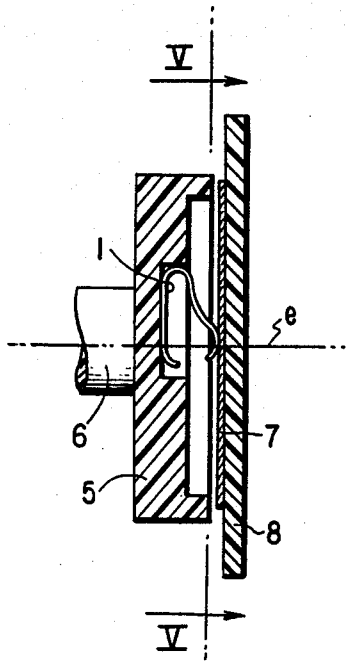
FIG. 4 is an axial sectional view of a second type of potentiometer incorporating the slider designed according to the invention.

Referring now to FIGS. 4 and 5, there is illustrated a rotary potentiometer which incorporates the invention. Here, the plurality of contact elements 1 are secured in an aligned manner to a carrier 5 rotatable by a shaft 6 about the rotary axis *e*. Each contact element 1 is resiliently urged into engagement with a circular resistor track 7 affixed to an insulating substrate 8. As it may be well observed in FIG. 5, the imaginary line *f* formed by connecting the individual contact locations between each contact element 1 and the resistor track 7 is perpendicular to the direction of motion indicated by the arrows L.

By shaping each contact element 1 in a manner described in connection with FIGS. 1 and 2, the moment of inertia of the contact element in a direction perpendicular to the direction of springing motion is significantly increased with respect to a circular wire cross section. The result is a high tracking fidelity and the maintenance of a constant value of the distance between the individual contact elements 1. Further, by virtue of the circular cross section of the wire at the location of contact and the curved course of the wire at that location an approximately point-like, circular or nearly circular oval-shaped contact is ensured.

Turning now to FIG. 6, the graphs illustrated therein show the advantages of the multiple-contact slider designed according to the invention. Along the ordinate there are shown the percentage variation of the contact resistance, whereas along the abcissa there is measured the path of regulation, such as the angle of rotation in a rotary potentiometer.

In case a single contact element 1 designed according to the invention is used, the contact resistance was found to oscillate between peak values that may be greater than 10% (curve 4). It is noted that in the present-day conventional sliders (top-of-the-line quality) there may be obtained — although only with the application of excessively high contact pressures — a contact resistance deviation as low as 3%

As it may be further observed in FIG. 3, if a slider is used that has three contact elements 1 designed according to the invention, the scatter of the contact resistance was found to extend scarcely beyond 3% (curve 3). In case of six contact elements 1, the scatter remained under 2% (curve 2) and in case of nine contact elements 1, the scatter was found not even to reach 1.5% (curve 1).

The invention also pertains to a method of making the contact elements described in connection with FIGS. 1-6. This method will now be described.

A spring wire of circular cross section is wound helically about a linear, ductile, insulated or non-insulated mandrel of circular cross section.

Subsequently, the helix-and-mandrel assembly is bilaterally flattened by opposite cylindrical rollers so that each turn of the helix will have substantially linearly extending, opposite long sides and substantially semicircularly extending opposite short sides. This preparatory metal working is known in the art and thus does not form part of the invention. It is noted that advantageously the ratio of the minor diameter (that is, the line interconnecting the long sides of a helix turn) and the major diameter (that is, the line interconnecting the short sides of a helix turn and extending perpendicularly to the minor diameter) is at least 1:1.6.

Figure 7:
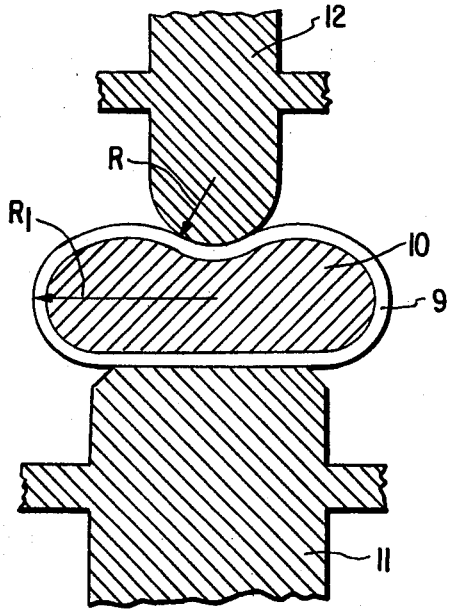
FIG. 7 is a schematic sectional view of shaping tools working on a wire helix to be deformed.

Referring now to FIG. 7, subsequent to the above-described first deforming operation a second deforming operation is performed. For this purpose, the helix 9 which is wound about the mandrel 10, is supported along one of its long sides by a cylindrical roll 11, while a longitudinally extending depression is rolled into the other long side of the helix by means of a roller 12 which has a peripheral working surface of a radius of curvature R. Advantageously, R is smaller than the radius $R_1$ of a circle circumscribable about each turn of the helix 9. As a result of this second rolling operation, each turn of the helix 9 will have an arcuately depressed (deformed) shape and flattened wire cross section as described in connection with FIGS. 1 and 2.

Thereafter, the helix turns, at that long side which is opposite from the side treated by the roll 12, are electrically and mechanically interconnected, for example, by means of soldering and/or by applying a carrier plate extending longitudinally of the helix.

Figure 8:
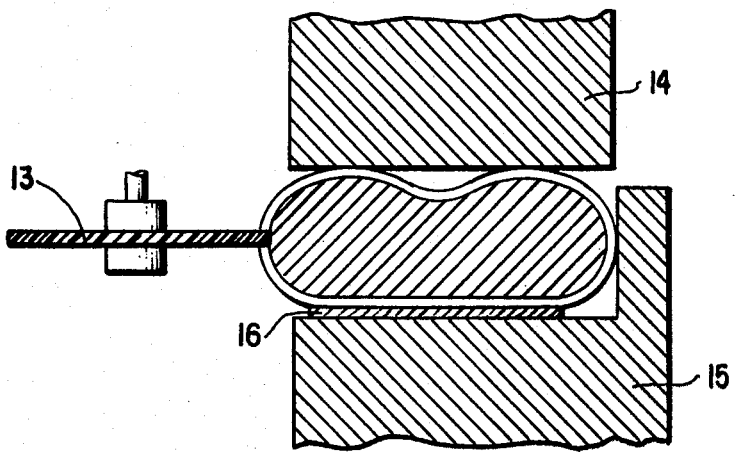
FIG. 8 is a schematic sectional view of a cutting tool severing the wire helix deformed according to FIG. 7.

Turning now to FIG. 8, each turn of the helix 9 is cut through in a single operation in a direction parallel to the helix axis by means of, for example, a circular metal saw 13. Advantageously, the saw 13 cuts the spring wire of each turn in a plane that is perpendicular to the minor axis of the elongated helix turns. To stabilize the helix structure for the cutting operation, oppositely located support tools 14 and 15 may be used to firmly hold the helix-and-mandrel assembly affixed to the above-described carrier plate 16. By virtue of the stresses generated in the helix 9 by the first and second rolling operations, as the turns of the helix are cut through, they spring open to assume an opening angle $\alpha$ as shown in FIG. 1. Since these stresses are of uniform magnitude throughout the helix, $\alpha$ will be identical in all the turns of the helix. As a result, in the completed structure, the individual turns of the helix which thus constitute the individual contact elements will exert identical contact pressures.

As a result of the opening of each turn of the helix, the mandrel 10 is freed and can be readily removed. Because of the previous electrical and mechanical connecting operation there is now obtained a unitary structure of a plurality of mutually immobilized individually resilient, aligned contact elements.

Subsequently, the helix may be severed, in a plane perpendicular to the helix axis, into desired length portions adapted to the particular slider.

With the aid of the above-described manufacturing method it is thus possible to make a slider consisting of a plurality of identically designed contact elements, each having a substantial rigidity in a direction perpendicular to the direction of slider motion. Further, the resilient pressure of each contact element — due to the spring having a flattened portion and extending through almost a semicircle — remains practically constant even in case of irregularities in the resistor track or in case of a not precisely normal position of the axis of rotation of the slider of a rotary potentiometer. This result is achieved because, first, the springing force effective along the length portion $\overline{DE}$ of each contact element 1 (FIG. 1), that is, in the direction of engagement and disengagement of the contact elements with respect to the resistor track, is substantially constant due to the small moment of inertia and second, changes in the spring force due to the irregularities to be expected in the resistor track are negligible because of the substantial spring length.

The partially band-shaped structure of the spring is furthermore very advantageous for achieving tracking fidelity on the resistor track since excursions in the plane of the resistor track perpendicular to the direction of slider motion require a much greater force than necessary for the lifting of the contact element. By virtue of the above-discussed two effects the setting accuracy and thus the reproducibility is significantly increased with respect to prior art structures.

The internal stresses generated as a result of the deformation obtained during the rolling steps result in a reserve in the opening angle of the contact element whereby the installation — also because of the soft springing force achieved by the relatively long spring length — is substantially facilitated and the slider is less liable to malfunctioning.

It will be understood that the above description of the present invention is susceptible to various modifications, changes and adaptations, and the same are intended to be comprehended within the meaning and range of equivalents of the appended claims.

We claim:

1. A method of making an electric slider having a plurality of uniformly spaced, independently springing, aligned resilient contact elements, comprising the following steps:

(a) deforming a helix made of a resilient wire of circular cross section and tightly wound on a ductile mandrel; the helix having elongated turns formed of opposite first and second long sides and opposite first and second short sides; said deforming step including (1) rolling the helix along its length and across the second long side of each turn by a roller having a circularly convex rolling face for flattening the cross section of the second long side of each turn of the helix by providing, as a result of the rolling step, an arcuate depression in the second long side of each turn of the helix;

(2) supporting the helix, simultaneously with the rolling step, at the first long side of each turn;

(b) electrically and mechanically connecting all the adjoining turns of the helix with one another at their first long side;

(c) severing each turn of the helix at said first short side; and (d) removing the mandrel from the helix.

2. A method as defined in claim 1, wherein the rolling step includes the forming of said arcuate depression with a diameter of curvature that is smaller than the radius of a circle circumscribable about the turns of the helix tightly wound about the mandrel.

3. A method as defined in claim 1, further comprising the step of severing, subsequent to step (c), the helix into portions of predetermined lengths.

* * * * *